US011455924B1

(12) United States Patent
Lee et al.

(10) Patent No.: US 11,455,924 B1
(45) Date of Patent: Sep. 27, 2022

(54) SYSTEM AND METHOD FOR LCD DISPLAY PANEL FAILURE DIAGNOSTICS

(71) Applicant: Dell Products L.P., Round Rock, TX (US)

(72) Inventors: Jong Seo Lee, Austin, TX (US); Asim Siddiqui, Cedar Park, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/390,114

(22) Filed: Jul. 30, 2021

(51) Int. Cl.
*G09G 3/00* (2006.01)
*G09G 3/36* (2006.01)

(52) U.S. Cl.
CPC ..... *G09G 3/006* (2013.01); *G09G 3/3685* (2013.01); *G09G 2310/08* (2013.01); *G09G 2330/10* (2013.01); *G09G 2330/12* (2013.01); *G09G 2370/00* (2013.01)

(58) Field of Classification Search
None
See application file for complete search history.

(56) References Cited

U.S. PATENT DOCUMENTS

| | | | | |
|---|---|---|---|---|
| 7,676,572 | B2 | 3/2010 | Kase | |
| 2015/0341631 | A1 | 11/2015 | Lu | |
| 2017/0345383 | A1 * | 11/2017 | Yin | G09G 3/3688 |
| 2019/0156783 | A1 * | 5/2019 | Kim | G09G 3/3685 |
| 2019/0213936 | A1 * | 7/2019 | Cho | G01R 31/52 |
| 2021/0286002 | A1 * | 9/2021 | Song | G09G 3/2003 |

* cited by examiner

*Primary Examiner* — Aneeta Yodichkas
(74) *Attorney, Agent, or Firm* — Larson Newman, LLP

(57) ABSTRACT

A liquid crystal display (LCD) device includes a LCD panel and a source driver. The LCD panel includes pixel data inputs and a failure sensing circuit. The pixel data inputs are coupled to columns of pixel elements. The failure sensing circuit provides a failure indication on an output of the LCD panel. In a test mode, the source driver drives a first voltage onto all of the first pixel data inputs. The failure indication includes the first voltage when the LCD panel has no failures on any of the first pixel elements, and the failure indication includes any other second voltage when the LCD panel has at least one failing pixel element.

20 Claims, 3 Drawing Sheets

SYSTEM AND METHOD FOR LCD DISPLAY PANEL FAILURE DIAGNOSTICS

FIELD OF THE DISCLOSURE

This disclosure generally relates to information handling systems, and more particularly relates to LCD display panel failure diagnostics.

BACKGROUND

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, reservations, enterprise data storage, or global communications. In addition, information handling systems may include a variety of hardware and software resources that may be configured to process, store, and communicate information and may include one or more computer systems, data storage systems, and networking systems.

SUMMARY

A liquid crystal display (LCD) device may include a LCD panel and a source driver. The LCD panel may include pixel data inputs and a failure sensing circuit. The pixel data inputs may be coupled to columns of pixel elements. The failure sensing circuit may provide a failure indication on an output of the LCD panel. In a test mode, the source driver may drive a first voltage onto all of the first pixel data inputs. The failure indication may include the first voltage when the LCD panel has no failures on any of the first pixel elements, and the failure indication may include any other second voltage when the LCD panel has at least one failing pixel element.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF DRAWINGS

The following description in combination with the Figures is provided to assist in understanding the teachings disclosed herein. The following discussion will focus on specific implementations and embodiments of the teachings. This focus is provided to assist in describing the teachings, and should not be interpreted as a limitation on the scope or applicability of the teachings. However, other teachings can certainly be used in this application. The teachings can also be used in other applications, and with several different types of architectures, such as distributed computing architectures, client/server architectures, or middleware server architectures and associated resources.

Figure 1:
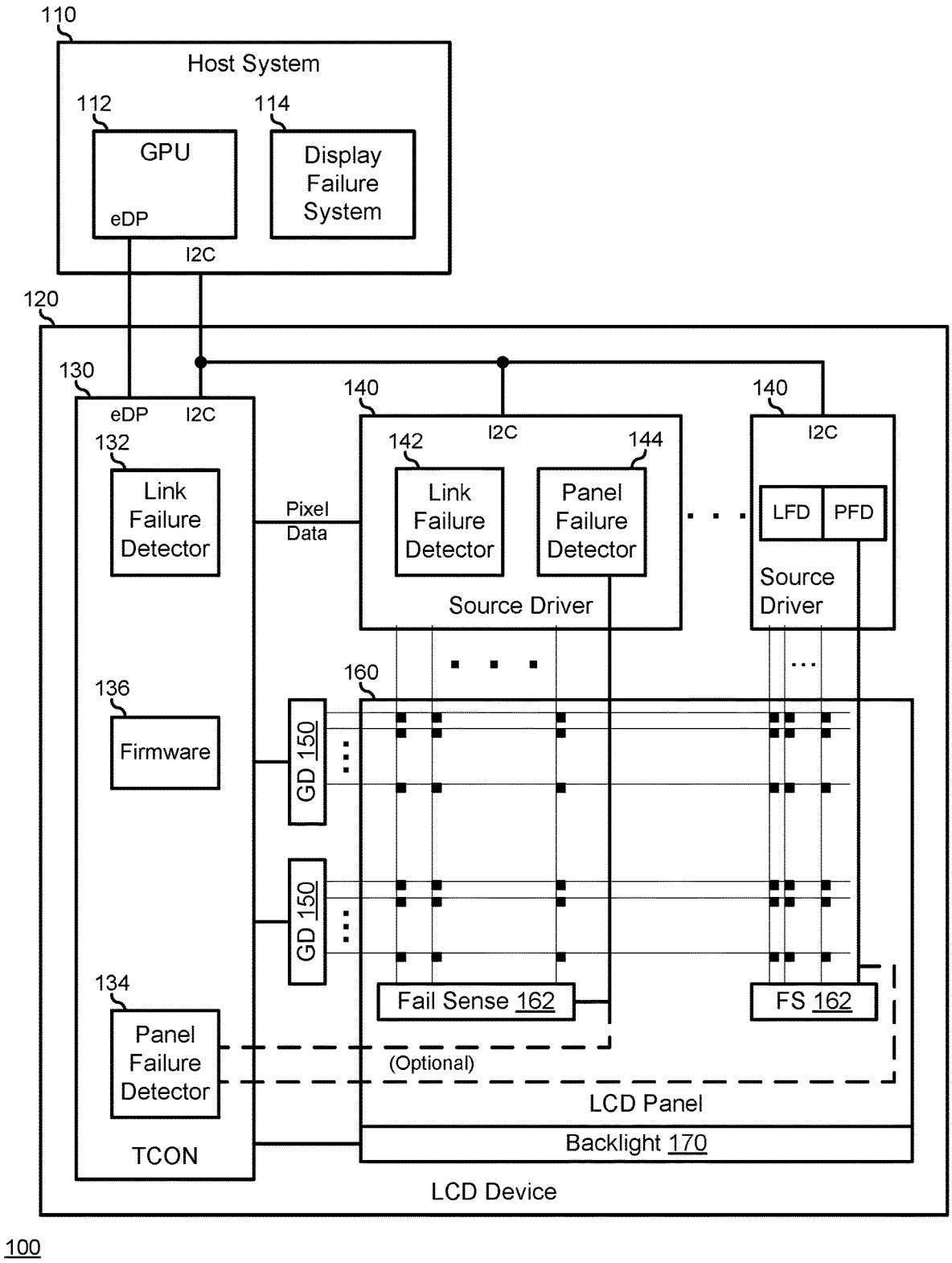
FIG. 1 is a block diagram of an information handling system according to an embodiment of the current disclosure.

FIG. 1 illustrates an information handling system 100, including a host processing system 110 and a Liquid Crystal Display (LCD) device 120. Information handling system 100 represents a computing device that presents image data on LCD device 120. In particular, information handling system 100 may represent a general computing device with an integrated LCD device, such as a laptop computer system, a tablet or notebook system, a cellular device, or the like, or the information handling system may represent a display device whose purpose is to present image date for another computing device, such as a stand-alone monitor or display system. Where information handling system 100 represents such a stand-alone monitor or display system, the information handling system will be understood to receive image data from an external source, such as a HDMI cable connected to a source device, and the information handling system will be understood to include a substantial degree of intelligence as represented by host system 110.

Host system 110 represents a processing system, including processing hardware, software, firmware, and the like, to perform the functions and features of information handling system 100. Where information handling system 100 represents a full-featured general computing device, the functions and features of host system 110 will represent a fully functional operating environment for the execution of programs and code to perform user-desired function. On the other hand, where information handling system 100 represents a display device, the functions and features of host system 110 will represent a more limited functionality sufficient to monitor, manage, maintain, and operate in its capacity as a display device.

Host system 110 includes a graphics processing unit (GPU) 112, and a display failure system 114. GPU 112 represents a coprocessor of host system 110, and may represent a full featured GPU that performs advanced 3-D rendering, shading, other image processing functions or the like, or may represent a more modest GPU that receives data from a computer in a first format, for example in a HDMI format, and renders the received data in another format, such as an embedded DataPort (eDP) format for use by LCD device 120. Display failure system 114 will be described further below. The operations of host systems, GPUs, and the like are known in the art and will not be further describe herein, except as needed to illustrate the current embodiments.

LCD device 120 represents an integrated device that is configured to receive image data and to convert the image data into the image displayed on the LCD device. As such, LCD device 120 includes a timing controller 130, one or more source drivers 140, one or more gate drivers 150, a LCD panel 160, and a backlight 170. Timing controller 130 represents a device that operates to receive the image data from GPU 112 and to control the operations of source drivers 140, gate drivers 150, and backlight 160 to provide an image on LCD panel 160. In particular, timing controller 130 operates to translate the image data into pixel data that is transmitted to source drivers 140, to control gate drivers 150 to clock the pixel data to the appropriate pixels of panel 160, and to control image quality and contrast by driving backlight 170 to various brightness levels, as needed or desired.

As such timing controller 130 operates to control image aspects such as color, contrast, brightness, image refresh rate, and the like. Timing controller 130 includes a link failure module 132, an optional panel failure detector 134 as described below, a non-volatile memory device to store a firmware image 136, and an Inter-Integrated Circuit (I2C) interface connected to an I2C bus that is also connected to I2C interfaces of host system 110 and source drivers 140. The I2C interfaces and I2C bus may be understood to represent any of a number of different simple device interfaces, such as a System Management Bus (SMB), a Serial Peripheral Interconnect (SPI) interface, a Low Pin Count (LPC) interface, or the like. Link failure detector 132, panel failure detector 134, and firmware 136 will be described further below. Timing controller 130 may represent a single integrated circuit device or a printed circuit board (PCB) including one or more integrated circuit device and other devices as needed or desired. The details of timing controllers design, manufacture, and implementation are known in the art and will not be further described herein, except as needed to illustrate the current embodiments.

Source drivers 140 operate to receive the pixel data from timing controller 130 and to provide sequential voltage inputs to LCD panel 160 to store pixel voltage levels for associated columns of thin-film transistors associated with each pixel, and gate drivers 150 provide clocking to the rows of pixels to latch the pixel voltage levels until the next scan of rows by the gate drivers. Backlight 170 provides a light source for illuminating LCD panel 160. Source drivers, gate drivers, LCD panels, and backlights, and the interactions therebetween to provide images on a surface of the LCD panels are known in the art and will not be further described herein, except as needed to illustrate the current embodiments. Source drivers 140 each include a link failure detector 142 and a panel failure detector 144. Link failure detector 142 and a panel failure detector 144 will be described further below.

Display failure system 114 provides a robust display detection system that operates to detect failures in the eDP link between GPU 112 and timing controller 130, failures in the pixel data link between the timing controller and source drivers, firmware installations failures in firmware 130, and electrical failures in LCD panel 160. In particular, display failure system 114 represents an interface that permits the guided testing or automated testing of the various features of information handling system 100 related to GPU 112 and LCD device 120, and the reporting of the results of the testing for system debug, failure analysis, monitoring, and maintenance. In a particular embodiment, where information handling system 100 represents a general computing device, display failure system 114 may be understood to represent a user accessible application or utility that presents the user with options for testing the features of the information handling system, and for viewing the results of the testing. An example of an application or utility may include a stand-alone application, an operating system utility, a LCD device driver, a system Basic Input/Output System (BIOS)/Universal Extensible Firmware Interface (UEFI), or the like, and may include a user interface as needed or desired. In another embodiment, where information handling system 100 represents a display device, display failure system 114 may be understood to represent a user accessible utility embedded in the information handling system, as needed or desired.

When display failure system 114 operates to detect failures in the eDP link between GPU 112 and timing controller 130, the display failure system sends an I2C command to the timing controller to enter an eDP link test mode, and directs GPU 112 to initiate a test signal on the eDP link to the timing controller. Link failure detector 132 receives the test signal and verifies the contents of the test signal. In a first embodiment, the test signal includes predetermined content that link failure detector 132 is configured to detect, and the timing controller verifies that the received test signal matches the predetermined content. If the test signal is verified, then link failure detector 132 issues an I2C transaction to display failure system 114 indicating that the received test signal matches the test signal sent by GPU 112 and that the eDP link is sound.

On the other hand, if the test signal is not verified, then link failure detector 132 issues an I2C transaction to display failure system 114 indicating that the received test signal did not match the test signal sent by GPU 112 and that the eDP link is faulty. In another embodiment, the test signal includes content that is unknown by link failure detector 132, but the test signal is provided to GPU 112 by display failure system 114. Here, in response to timing controller 130 entering the eDP test mode, link failure detector 132 provides the received content back to display failure system 114 via the I2C bus, and the display failure system makes the comparison to determine if the content transmitted by GPU 112 matches the content received by the timing controller.

In a particular embodiment, when display failure system 114 operates to detect failures in the pixel data link between timing controller 130 and source drivers 140, the display failure system sends an I2C command to the timing controller and the source drivers to enter a pixel link test mode, and directs the timing controller to initiate a test signal on the pixel link to the source drivers. In a first case, source drivers 140 receive the test signal and verify the contents of the test signal. Here, when the test signal includes predetermined content that link failure detectors 142 are configured to detect, and the source drivers verify that the received test signal matches the predetermined content. If the test signal is verified by a particular link failure detector 142, then that link failure detector issues an I2C transaction to display failure system 114 indicating that the received test signal matches the test signal sent by timing controller 130 and that the pixel link is sound as to that source driver.

On the other hand, if the test signal is not verified by a particular link failure detector 142, then that link failure detector issues an I2C transaction to display failure system 114 indicating that the received test signal did not match the test signal sent by timing controller 130 and that the pixel link is faulty as to that source driver. When the test signal includes content that is unknown by link failure detector 432, the test signal is provided by timing controller 130. Here, in response to source drivers 140 entering the pixel test mode, link failure detector 142 provides the received content back to timing controller 130 via the I2C bus, and the timing controller makes the comparison to determine if the content transmitted by the timing controller matches the content received by the source drivers.

Then, timing controller 130 issues an I2C transaction to display failure system 114 indicated whether the pixel link is sound or faulty as to each timing controller. In another embodiment, when display failure system 114 operates to detect failures in the pixel data link between timing controller 130 and source drivers 140, the display failure system sends an I2C command to the timing controller to enter a pixel link test mode. Timing controller 130 then sends an I2C command to source drivers 140 to enter the pixel link test mode, and initiates the test signal on the pixel link to the source drivers. Here, the test signal can include predetermined content or unknown content to link failure detectors 142, and failure reporting may be as described above.

When display failure system 114 operates to detect firmware installations failures in firmware 136, the display failure system sends an I2C command to timing controller 130 to query the firmware to determine if there were any installation failures. In particular, timing controller 130 operates to verify a checksum or other signature of firmware 136 to ensure that the contents of the firmware have not been tampered with, and further determines a firmware revision associated with the installed firmware. If the verification is successful, timing controller 130 responds to display failure system 114 that firmware 136 is verified. Otherwise, timing controller 130 responds to display failure system 114 that firmware 136 is unverified. In either case, timing controller 130 operates to report the firmware revision to display failure system 114. If firmware 136 is unverified, display failure system 114 initiates a reinstall of the firmware code to timing controller 136. Further, display failure system 114 operates to verify that the firmware revision is a latest firmware revision. If there is a newer version of the firmware, display failure system 114 operates to obtain the newer version of the firmware and initiates an install of the new firmware code to timing controller 136.

LCD panel 160 includes at least one fail sense circuit 162. In a particular embodiment, LCD panel 160 includes one fail sense circuit 162 associated with each of source drivers 140. In another embodiment, LCD panel 160 include one fail sense circuit 162. Fail sense circuit 162 is connected to each pixel input column at a bottom of the column, that is, at a circuit node that is furthest removed from the pixel input column signal provided by source driver 140. Fail sense circuit 162 operates to detect a voltage on the pixel input columns. In a particular embodiment, fail sense circuit 162 represents a ground node for the pixel input columns, and a switching device that isolates the ground node from a ground plane of LCD panel 160 during a panel failure detection mode, and connects the ground node to an output of the LCD panel. In this embodiment, LCD panel 160 may include an input that places the LCD panel into the panel failure detection mode and operates the switching device.

The voltage detected by fail sense circuit 162 is provided on the output to an input to panel failure detector 144. Here, when source driver 140 is placed into a panel failure detection mode, the source driver places a known voltage on each pixel input column and panel failure detector 144 senses the voltage at the bottom of all of the columns. If all of the pixel thin-film transistors in each of the pixel input columns are correctly connected to the associate pixel input columns, then the voltage provided at the input by source driver 140 will be detected by panel failure detector, and LCD panel 160 will be understood to be soundly connected to the source driver. On the other hand, if any of the pixel thin-film transistors are shorted to ground or otherwise connected in a high impedance state, then a different voltage will be detected by panel failure detector 144 than the voltage that was provided at input by source driver 140, LCD panel 160 will be understood to have a faulty connection to the source driver.

When display failure system 114 operates to detect electrical failures in LCD panel 160, the display failure system sends an I2C command to source drivers 140 to place the source drivers into the panel failure detection mode. Then panel failure detector 144 provides an I2C transaction to display failure system 114 indicating whether the connection between source drivers 140 and LCD panel 160 is sound or is faulty. In another embodiment, source drivers 140 implement the panel failure detection mode, but do not necessarily include panel failure detector 144. Here, rather than providing the voltage detected by fail sense circuit 162 to an input of source driver 140, the detected voltage is provided to panel failure detector 134 of timing controller 130. Here, timing controller 130 initiates the panel failure detection mode in source drivers 140 via an I2C transaction, and panel failure detector 134 determines whether the connection between the source driver and LCD panel 160 is sound or is faulty, and the timing controller provides the indication to display failure system 114.

Display failure system 114 may included a graphical user interface (GUI) that permits a user to select various test modes. In particular, the GUI may include individual test selections for testing the eDP link, the pixel link, the firmware, and the LCD panel. In addition, the GUI may include a test selection for testing all of the test selections. Further, the GUI may provide visible representations of the testing status. For example, a test selection may be shown in a neutral color when that test has not been run, may blink when the test is being performed, may be shown in green when the test is run with no issues, and may be shown in red when the test failed. The GUI may further include options for obtaining details on the test results or for reporting the rest results to a service provider.

In a particular embodiment, the teachings of link failure detection, firmware integrity detection, and panel failure detection are incorporated into a touch sensing panel for detecting user inputs, such as might be found on a smart phone or tablet device. Here, rather than interacting with a source driver as described above, the interactions described above are implemented on a readout integrated circuit as may be found on a touch panel device.

Figure 2:
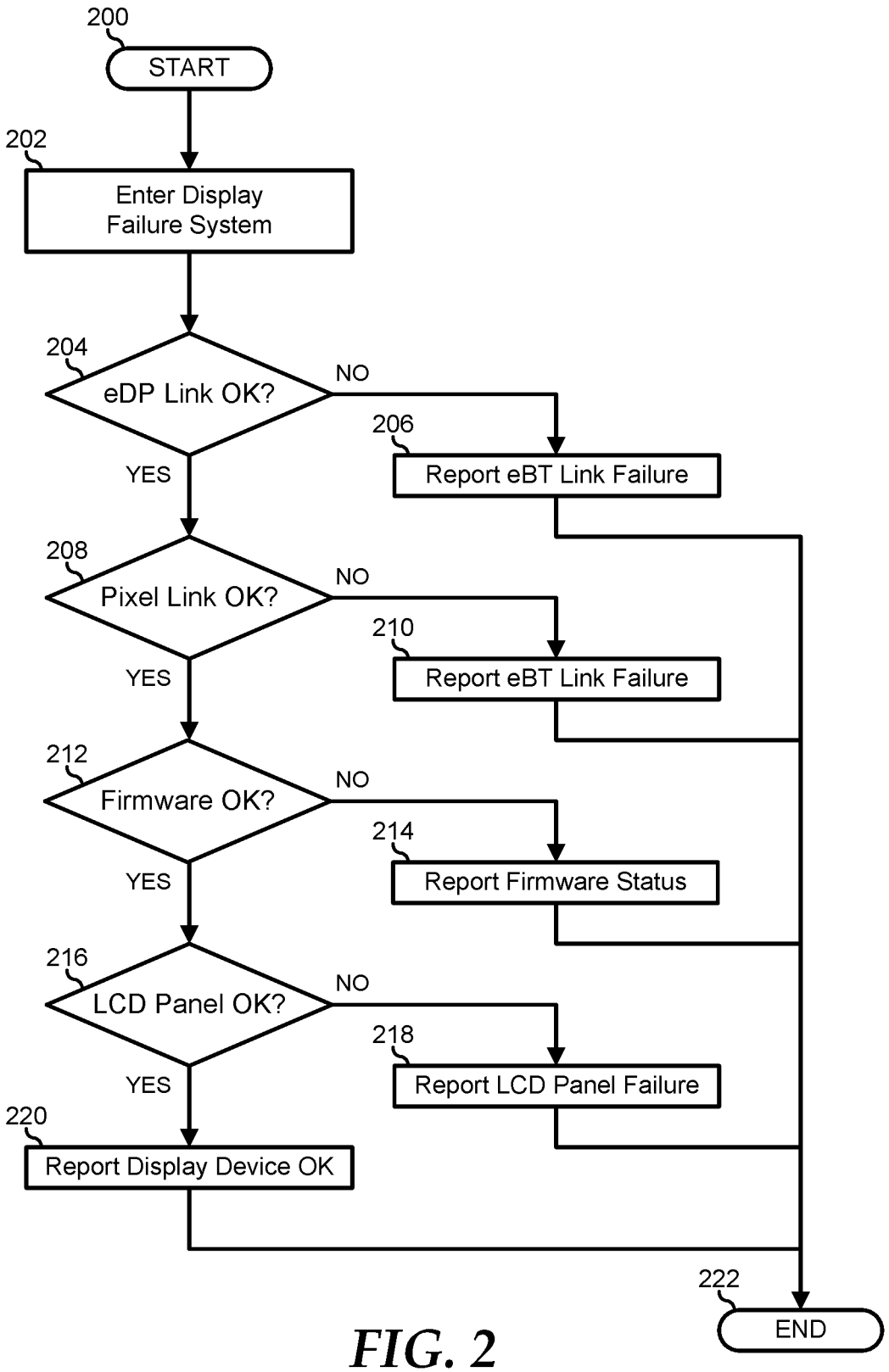
FIG. 2 is a flowchart illustrating a method for testing a display system according to an embodiment of the current disclosure.

FIG. 2 illustrates a method for testing a display system starting at block 200. A display failure system is entered in block 202. A decision is made as to whether or not the eDP link of a display system is sound in decision block 204. If not, the "NO" branch of decision block 204 is taken and the eDP link failure is reported to a GUI of the display failure system in block 206. If the eDP link is sound, the "YES" branch of decision block 204 is taken and a decision is made as to whether or not the pixel link of a display system is sound in decision block 208. If not, the "NO" branch of decision block 208 is taken and the pixel link failure is reported to the GUI in block 210. If the pixel link is sound, the "YES" branch of decision block 208 is taken and a decision is made as to whether or not the firmware of a display system is valid and up to date in decision block 212. If not, the "NO" branch of decision block 212 is taken and the firmware is reported as unvalidated or out of date to the GUI in block 214 If the firmware is valid and updated, the "YES" branch of decision block 212 is taken and a decision is made as to whether or not the LCD panel is sound in decision block 216. If not, the "NO" branch of decision block 216 is taken and the LCD panel failure is reported to the GUI in block 218 If the LCD panel is sound, the "YES"

branch of decision block 216 is taken, the display system is reported as being OK to the GUI in block 220, and the method ends in block 222.

Figure 3:
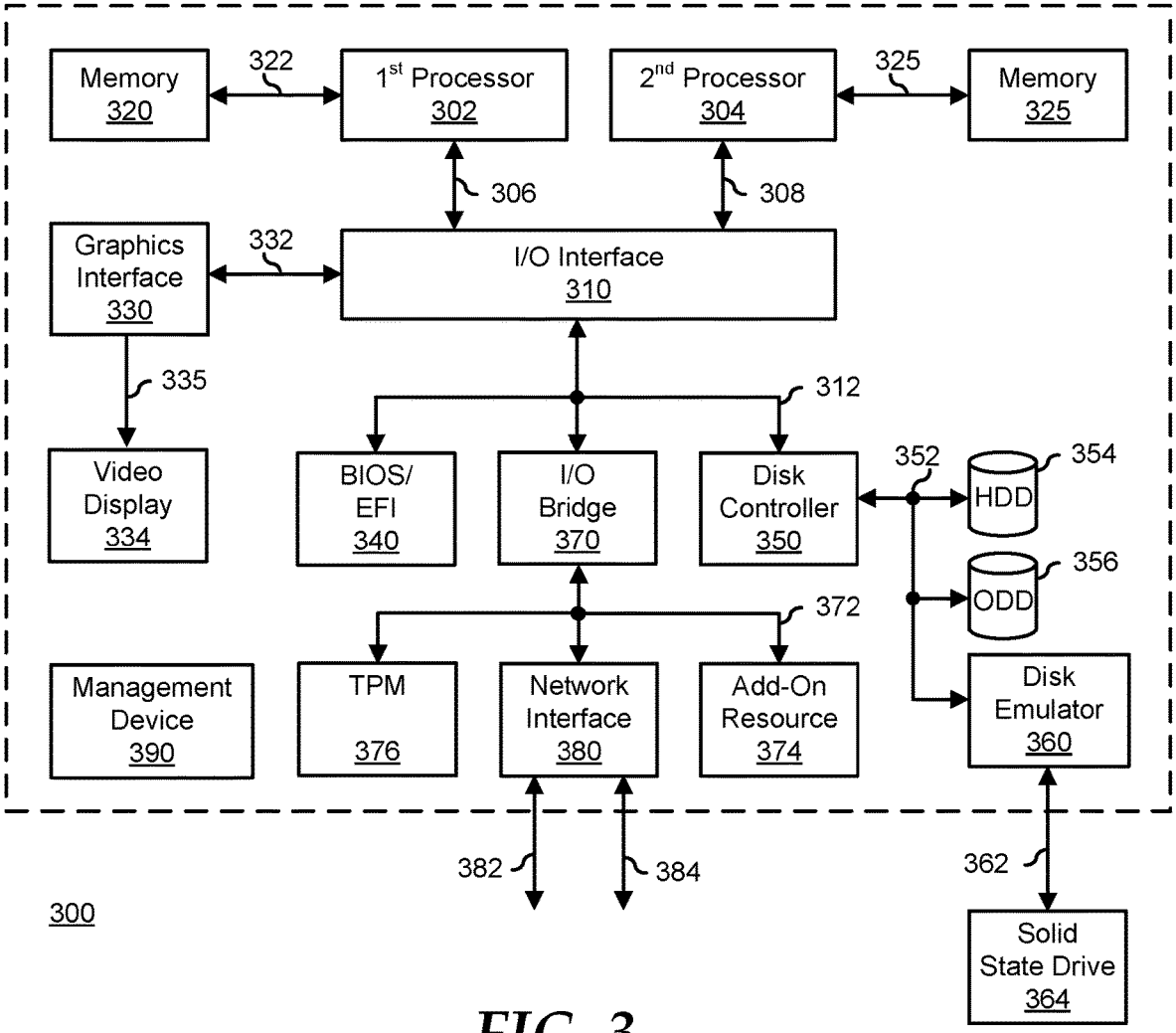
FIG. 3 is a block diagram illustrating a generalized information handling system according to another embodiment of the present disclosure.

FIG. 3 illustrates a generalized embodiment of an information handling system 300. For purpose of this disclosure an information handling system can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 300 can be a personal computer, a laptop computer, a smart phone, a tablet device or other consumer electronic device, a network server, a network storage device, a switch router or other network communication device, or any other suitable device and may vary in size, shape, performance, functionality, and price. Further, information handling system 300 can include processing resources for executing machine-executable code, such as a central processing unit (CPU), a programmable logic array (PLA), an embedded device such as a System-on-a-Chip (SoC), or other control logic hardware. Information handling system 300 can also include one or more computer-readable medium for storing machine-executable code, such as software or data. Additional components of information handling system 300 can include one or more storage devices that can store machine-executable code, one or more communications ports for communicating with external devices, and various input and output (I/O) devices, such as a keyboard, a mouse, and a video display. Information handling system 300 can also include one or more buses operable to transmit information between the various hardware components.

Information handling system 300 can include devices or modules that embody one or more of the devices or modules described below, and operates to perform one or more of the methods described below. Information handling system 300 includes a processors 302 and 304, an input/output (I/O) interface 310, memories 320 and 325, a graphics interface 330, a basic input and output system/universal extensible firmware interface (BIOS/UEFI) module 340, a disk controller 350, a hard disk drive (HDD) 354, an optical disk drive (ODD) 356, a disk emulator 360 connected to an external solid state drive (SSD) 362, an I/O bridge 370, one or more add-on resources 374, a trusted platform module (TPM) 376, a network interface 380, a management device 390, and a power supply 395. Processors 302 and 304, I/O interface 310, memory 320, graphics interface 330, BIOS/UEFI module 340, disk controller 350, HDD 354, ODD 356, disk emulator 360, SSD 362, I/O bridge 370, add-on resources 374, TPM 376, and network interface 380 operate together to provide a host environment of information handling system 300 that operates to provide the data processing functionality of the information handling system. The host environment operates to execute machine-executable code, including platform BIOS/UEFI code, device firmware, operating system code, applications, programs, and the like, to perform the data processing tasks associated with information handling system 300.

In the host environment, processor 302 is connected to I/O interface 310 via processor interface 306, and processor 304 is connected to the I/O interface via processor interface 308. Memory 320 is connected to processor 302 via a memory interface 322. Memory 325 is connected to processor 304 via a memory interface 327. Graphics interface 330 is connected to I/O interface 310 via a graphics interface 332, and provides a video display output 336 to a video display 334. In a particular embodiment, information handling system 300 includes separate memories that are dedicated to each of processors 302 and 304 via separate memory interfaces. An example of memories 320 and 330 include random access memory (RAM) such as static RAM (SRAM), dynamic RAM (DRAM), non-volatile RAM (NV-RAM), or the like, read only memory (ROM), another type of memory, or a combination thereof.

BIOS/UEFI module 340, disk controller 350, and I/O bridge 370 are connected to I/O interface 310 via an I/O channel 312. An example of I/O channel 312 includes a Peripheral Component Interconnect (PCI) interface, a PCI-Extended (PCI-X) interface, a high-speed PCI-Express (PCIe) interface, another industry standard or proprietary communication interface, or a combination thereof. I/O interface 310 can also include one or more other I/O interfaces, including an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof. BIOS/UEFI module 340 includes BIOS/UEFI code operable to detect resources within information handling system 300, to provide drivers for the resources, initialize the resources, and access the resources. BIOS/UEFI module 340 includes code that operates to detect resources within information handling system 300, to provide drivers for the resources, to initialize the resources, and to access the resources.

Disk controller 350 includes a disk interface 352 that connects the disk controller to HDD 354, to ODD 356, and to disk emulator 360. An example of disk interface 352 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 360 permits SSD 364 to be connected to information handling system 300 via an external interface 362. An example of external interface 362 includes a USB interface, an IEEE 1394 (Firewire) interface, a proprietary interface, or a combination thereof. Alternatively, solid-state drive 364 can be disposed within information handling system 300.

I/O bridge 370 includes a peripheral interface 372 that connects the I/O bridge to add-on resource 374, to TPM 376, and to network interface 380. Peripheral interface 372 can be the same type of interface as I/O channel 312, or can be a different type of interface. As such, I/O bridge 370 extends the capacity of I/O channel 312 when peripheral interface 372 and the I/O channel are of the same type, and the I/O bridge translates information from a format suitable to the I/O channel to a format suitable to the peripheral channel 372 when they are of a different type. Add-on resource 374 can include a data storage system, an additional graphics interface, a network interface card (NIC), a sound/video processing card, another add-on resource, or a combination thereof. Add-on resource 374 can be on a main circuit board, on separate circuit board or add-in card disposed within information handling system 300, a device that is external to the information handling system, or a combination thereof.

Network interface 380 represents a NIC disposed within information handling system 300, on a main circuit board of the information handling system, integrated onto another component such as I/O interface 310, in another suitable location, or a combination thereof. Network interface device 380 includes network channels 382 and 384 that provide interfaces to devices that are external to information handling system 300. In a particular embodiment, network channels 382 and 384 are of a different type than peripheral channel 372 and network interface 380 translates information from a format suitable to the peripheral channel to a format suitable to external devices. An example of network channels 382 and 384 includes InfiniBand channels, Fibre Channel channels, Gigabit Ethernet channels, proprietary channel architectures, or a combination thereof. Network channels 382 and 384 can be connected to external network resources (not illustrated). The network resource can include another information handling system, a data storage system, another network, a grid management system, another suitable resource, or a combination thereof.

Management device 390 represents one or more processing devices, such as a dedicated baseboard management controller (BMC) System-on-a-Chip (SoC) device, one or more associated memory devices, one or more network interface devices, a complex programmable logic device (CPLD), and the like, that operate together to provide the management environment for information handling system 300. In particular, management device 390 is connected to various components of the host environment via various internal communication interfaces, such as a Low Pin Count (LPC) interface, an Inter-Integrated-Circuit (I2C) interface, a PCIe interface, or the like, to provide an out-of-band (OOB) mechanism to retrieve information related to the operation of the host environment, to provide BIOS/UEFI or system firmware updates, to manage non-processing components of information handling system 300, such as system cooling fans and power supplies. Management device 390 can include a network connection to an external management system, and the management device can communicate with the management system to report status information for information handling system 300, to receive BIOS/UEFI or system firmware updates, or to perform other task for managing and controlling the operation of information handling system 300. Management device 390 can operate off of a separate power plane from the components of the host environment so that the management device receives power to manage information handling system 300 when the information handling system is otherwise shut down. An example of management device 390 include a commercially available BMC product or other device that operates in accordance with an Intelligent Platform Management Initiative (IPMI) specification, a Web Services Management (WSMan) interface, a Redfish Application Programming Interface (API), another Distributed Management Task Force (DMTF), or other management standard, and can include an Integrated Dell Remote Access Controller (iDRAC), an Embedded Controller (EC), or the like. Management device 390 may further include associated memory devices, logic devices, security devices, or the like, as needed or desired.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A liquid crystal display (LCD) device, comprising:

an LCD panel including a first plurality of pixel data inputs and a first failure sensing circuit, wherein the first pixel data inputs are each coupled to associated columns of first pixel elements, and wherein the first failure sensing circuit is configured to provide a first failure indication on a first output of the LCD panel;

a first source driver configured to drive first pixel data onto the first pixel data inputs, wherein in a first test mode, the first source driver is configured to drive a first voltage onto all of the first pixel data inputs; and a timing controller coupled to the first source driver by a pixel data link, the timing controller configured to provide the first pixel data to the first source driver via the pixel data link;

wherein in the first test mode, the first failure indication includes the first voltage when the LCD panel has no failures on any of the first pixel elements, and the first failure indication includes any other second voltage when the LCD panel has at least one failing first pixel element, wherein the at least one failing first pixel element is in a high impedance state; and wherein in a second test mode, the timing controller is configured to initiate a pixel data link test signal via the pixel data link, and the first source driver is further configured to provide a second failure indication indicating a failure on the pixel data link.

2. The LCD device of claim 1, wherein the at least one failing pixel element includes a shorted pixel element.

3. The LCD device of claim 1, wherein the first failure indication is provided on the first output of the LCD panel to an input of the first source driver.

4. The LCD device of claim 3, wherein the first source driver includes a communication interface, and is configured to receive a command on the communication interface to enter the first test mode.

5. The LCD device of claim 4, wherein the first source driver provides a response to the command, the response including a status of the first failure indication.

6. The LCD device of claim 1, wherein:

the LCD panel further includes a second plurality of pixel data inputs and a second failure sensing circuit, wherein the second pixel data inputs are each coupled to associated columns of second pixel elements, and wherein the second failure sensing circuit is configured to provide a third failure indication on a second output of the LCD panel;

the LCD device further comprises:

a second source driver configured to drive second pixel data onto the second pixel data inputs, wherein, in the first test mode, the second source driver is configured to drive the first voltage onto all of the second pixel data inputs; and in the first test mode, the third failure indication includes the first voltage when the LCD panel has no failures on any of the second pixel elements, and the third failure indication includes any other second voltage when the LCD panel has at least one failing second pixel element.

7. The LCD device of claim 1, further comprising:
a timing controller configured to provide the first pixel data to the first source driver.

8. The LCD device of claim 7, wherein the first failure indication is provided on the first output of the LCD panel to an input of the timing controller.

9. The LCD device of claim 8, wherein the timing controller includes a communication interface, and is configured to receive a command on the communication interface to enter the first test mode.

10. The LCD device of claim 9, wherein the timing controller provides a response to the command, the response including a status of the first failure indication.

11. A method of detecting failure in a liquid crystal display (LCD) device, the method comprising:
providing, in an LCD panel of the LCD display, a first plurality of pixel data inputs and a first failure sensing circuit, wherein the first pixel data inputs are each coupled to associated columns of first pixel elements, and wherein the first failure sensing circuit is configured to provide a first failure indication on a first output of the LCD panel;
driving, by a first source driver of the LCD device, first pixel data onto the first pixel data inputs;
providing, by a timing controller of the LCD device coupled to the first source driver by a pixel data link, the first pixel data to the first source driver via the pixel data link;
driving, by the first source driver in a first test mode, a first voltage onto all of the first pixel data inputs;
providing, in the first test mode, the first voltage on the first output when the LCD panel has no failures on any of the first pixel elements;
providing, in the first test mode, any other second voltage when the LCD panel has at least one failing first pixel element, wherein the at least one failing first pixel element is in a high impedance state;
initiating, by the timing controller in a second test mode, a pixel data link test signal via the pixel data link; and
providing, by the first source driver in the second test mode, a second failure indication indicating a failure on the pixel data link.

12. The method of claim 11, further comprising:
providing the first failure indication on the first output of the LCD panel to an input of the first source driver.

13. The method of claim 12, further comprising:
providing, on the first source driver, a communication interface; and
receiving a command on the communication interface to enter the first test mode.

14. The method of claim 13, further comprising:
providing, by the first source driver, a response to the command, the response including a status of the first failure indication.

15. The method of claim 11, wherein:
providing, in the LCD panel, a second plurality of pixel data inputs and a second failure sensing circuit, wherein the second pixel data inputs are each coupled to associated columns of second pixel elements, and wherein the second failure sensing circuit is configured to provide a third failure indication on a second output of the LCD panel; and
driving, by a second source driver of the LCD device, the first pixel data onto the first pixel data inputs;
driving, by the second source driver in a first test mode, the first voltage onto all of the first pixel data inputs;
providing, in the first test mode, the first voltage on the second output when the LCD panel has no failures on any of the second pixel elements: and
providing, in the first test mode, any other second voltage when the LCD panel has at least one failing second pixel element.

16. The method of claim 11, further comprising:
providing, by a timing controller of the LCD device, the first pixel data to the first source driver.

17. The method of claim 16, further comprising:
providing the first failure indication on the first output of the LCD panel to an input of the timing controller.

18. The method of claim 17, further comprising:
providing, on the timing controller, a communication interface; and
receiving a command on the communication interface to enter the first test mode.

19. The method of claim 18, further comprising:
providing, by the timing controller, a response to the command, the response including a status of the first failure indication.

20. An information handling system, comprising:
a processor; and
a liquid crystal display (LCD) device including:
an LCD panel including a first plurality of pixel data inputs and a first failure sensing circuit, wherein the first pixel data inputs are each coupled to associated columns of first pixel elements, and wherein the first failure sensing circuit is configured to provide a first failure indication on a first output of the LCD panel;
a first source driver configured to drive first pixel data onto the first pixel data inputs, wherein, in a first test mode, the first source driver is configured to drive a first voltage onto all of the first pixel data inputs; and
a timing controller coupled to the first source driver by a pixel data link, the timing controller configured to provide the first pixel data to the first source driver via the pixel data link;
wherein, in the first test mode, the first failure indication includes the first voltage when the LCD panel has no failures on any of the first pixel elements, and the first failure indication includes any other second voltage when the LCD panel has at least one failing first pixel element, wherein the at least one failing first pixel element is in a high impedance state;
wherein the processor directs the LCD device to enter the first test mode; and
wherein in a second test mode, the timing controller is configured to initiate a pixel data link test signal via the pixel data link, and the first source driver is further configured to provide a second failure indication indicating a failure on the pixel data link.

* * * * *